United States Patent [19]

Vesnaver

[11] Patent Number: 4,710,324

[45] Date of Patent: Dec. 1, 1987

[54] WATER AERATING DEVICE

[76] Inventor: Galdino Vesnaver, 5690 San Jacinto, Atascadero, Calif. 93422

[21] Appl. No.: 935,832

[22] Filed: Nov. 28, 1986

[51] Int. Cl.[4] ..... B01F 3/04

[52] U.S. Cl. ..... 261/30; 261/121.2; 261/124; 417/369; 417/373

[58] Field of Search ..... 261/121.2, 30; 417/369, 417/373; 261/124

[56] References Cited

U.S. PATENT DOCUMENTS

| | | | |
|---|---|---|---|
| 2,167,879 | 8/1939 | Des Roches | 417/373 |
| 2,281,144 | 4/1942 | Dillon | 417/373 |
| 2,460,527 | 2/1949 | Oliveros | 261/121.2 |
| 3,115,839 | 12/1963 | Pollak et al. | 417/369 |
| 3,189,334 | 6/1965 | Bell | 261/121.2 |
| 3,217,444 | 11/1965 | Howard | 261/121.2 |
| 3,252,422 | 5/1966 | Stulens | 417/369 |
| 3,394,659 | 7/1968 | Van Alen | 417/373 |
| 3,830,596 | 8/1974 | Kondo | 261/121.2 |
| 3,956,432 | 5/1976 | Hilling | 261/30 |
| 4,120,616 | 10/1978 | Dwyer et al. | 417/373 |

*Primary Examiner*—Tim Miles

*Attorney, Agent, or Firm*—Jerry N. Lulejian

[57] ABSTRACT

This is a device for aerating water comprising (1) a fan within a pumping chamber for drawing air through an intake port and forcing air out an exhaust port therein, (2) a fan enabling means located outside the pumping chamber for moving the fan so that air is drawn through the intake port and out the exhaust port, (3) a means for insulating the pumping chamber from the heat created by the fan enabling means, and (4) a means for dispersing the air flowing out of the exhaust port and into water.

1 Claim, 4 Drawing Figures

WATER AERATING DEVICE

BACKGROUND OF THE INVENTION

The present invention relates to devices for aerating water and specifically to devices for aerating water to keep fish alive in a confined aquatic environment.

Prior art water aerating devices have air pumps run by electric motors attached to fans within a pumping chamber. These prior art devices pull ambient air through the pumping chamber and disperse it into the water containing fish. The problem with these prior art devices is that they did not understand that the heat from the electric motor heats the pumping chamber and the air flowing therethrough. This heated air is not healthful to the fish contained in the water to be aerated.

The present invention was created with the discovery that the heated air was responsible for a less than perfectly healthful environment for the fish. In order to implement this discovery, the present invention calls for insulating the pumping chamber from the heat generated by the electric motor. Thus, the present invention has been able to significantly lengthen the life of fish within the water aerated by the present invention because the air is much closer to the ambient air temperature.

SUMMARY OF THE INVENTION

This is a device for aerating water comprising (1) a fan within a pumping chamber for drawing air through an intake port of the pumping chamber and forcing air out an exhaust port, (2) a fan enabling means located outside the pumping chamber for moving the fan so that air is drawn through the intake port and forced out the exhaust port of the pumping chamber, (3) a means for insulating the pumping chamber from the heat created by the fan enabling means, and (4) a means for dispersing the air flowing out the exhaust port into the water.

The present invention may also include a means for channeling some of the air flowing through the pumping chamber to the fan enabling means for cooling same.

Figure 1:
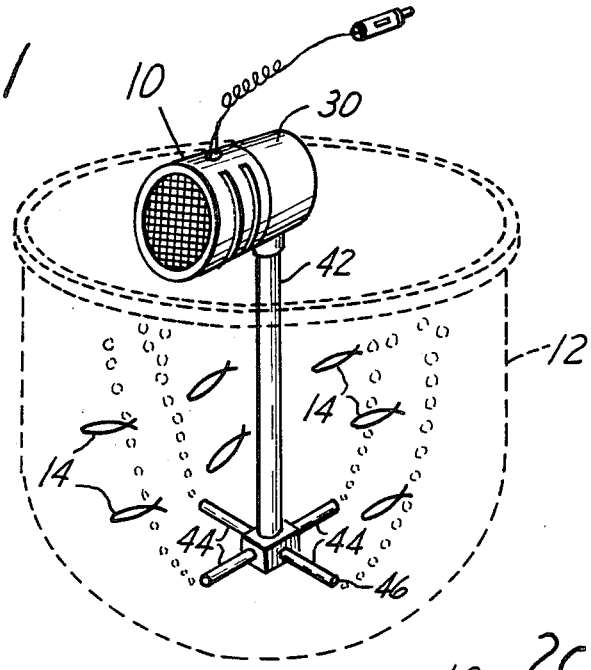
FIG. 1 is a perspective view of the present invention installed within a tank of water containing fish.
Figure 2A:
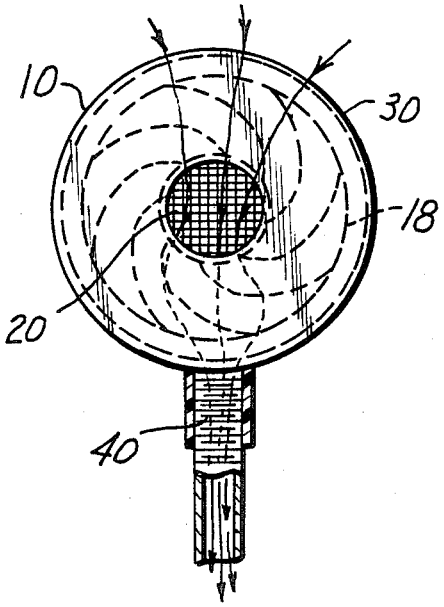
Figure 2B:
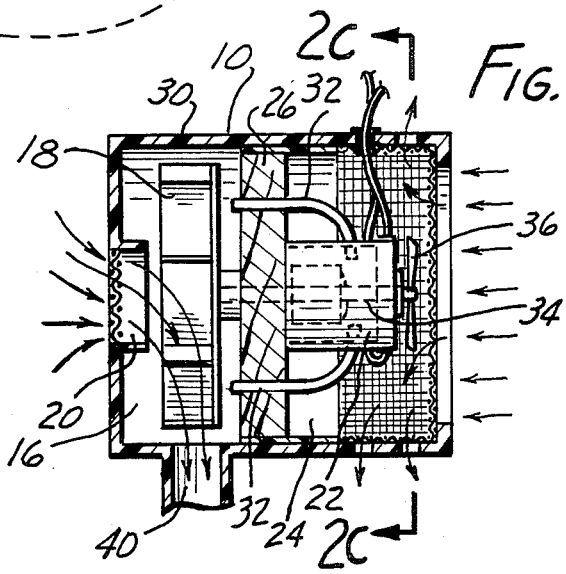
Figure 2C:
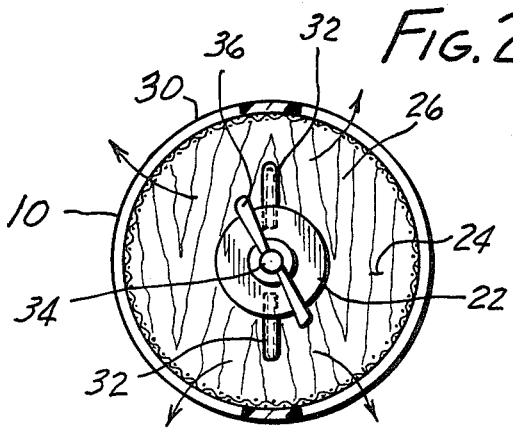

FIG. *2a* is a side elevational view of the pumping chamber side of the present invention.

FIG. *2b* is a side breakway view of the pumping chamber and motor housing of the present invention.

FIG. *2c* is a cross sectional view along lines *2c—2c* of FIG. *2b*.

DETAILED DESCRIPTION OF THE INVENTION

The present invention relates to devices for aerating water and specifically to devices for aerating water to keep fish alive in a confined aquatic environment.

Prior art water aerating devices have air pumps run by electric motors attached to fans within a pumping chamber. These prior art devices pull ambient air through the pumping chamber and disperse it into the water containing fish or other marine life. The problem with these prior art devices is that they did not understand that the heat from the electric motor heats the pumping chamber and the air flowing therethrough.

This heated air is not healthful to the fish contained in the water to be aerated.

The present invention was created with the discovery that the heated air was responsible for a less than perfectly healthful environment to the fish. In order to implement this discovery, the present invention calls for insulating the pumping chamber from the heat generated by the electric motor turning the fan within the pumping chamber. Thus, the present invention has been able to significantly lengthen the life of fish within the water aerated by the present invention because the air is much closer to the ambient air temperature.

Referring specifically to FIG. *2c*, the present invention 10 is installed above and within a tank 12 containing water and fish 14. The object of the present invention is to aerate the water within the tank 12 such that the air reaching the water within the tank 12 has a temperature resembling that of the ambient air surrounding tank 12.

Referring now to FIGS. *2a*, *2b* and *2c*, the present invention 10 preferably comprises a pumping chamber 16 which has within it a turbine 18 having curved wings as shown for circulating air through the pumping chamber 16 via an intake port 20 in the direction of the arrows indicated in FIG. *2b*. The turbine 18 is preferably turned with an electric motor 22 in a motor chamber 24. The electric motor 22 can be of any type that together with the turbine 18 will be able to draw sufficient amounts of ambient air and force them into the tank 12 to properly aerate the water for the number of fish and size of tank which is preferred. However, the speed of the electric motor 22 of the preferred embodiment of the present invention is between 18,000 and 22,000 R.P.M.

In order to prevent the heat from the electric motor 22 from reaching the pumping chamber 16, the present invention preferably has an insulating wall 26 of wood of other heat insulating substances. The pumping chamber 16 and motor chamber 24 can be within a single housing 30 made of plastic or other durable, heat insulating material.

In order to aid the cooling of the electric motor 24, the present invention may also comprise air channeling tubes 32 which extend through the insulating wall 26 and into the pumping chamber 16 in order to channel some of the air flowing therethrough into the electric motor 22. In addition, the electric motor 22 may also have installed on its main shaft 34 a metal fan blade 36 soldered to the main shaft 34 for circulating outside air around and through the electric motor 22 and for cooling the electric motor 22 and dissipating heat from the main shaft 34.

The air flowing through the intake port 20 flows through an exhaust port 40, preferably through tube 42 (FIG. 1) extending to the bottom of the tank 12 and out one or more distributing tubes 44. The distributing tubes 44 preferably have a hole 46 in their distributing ends which is preferably one thirty second of an inch (1/32") in diameter, where distributing tubes 44 have internal diameters of at least three sixteenths of an inch (3/16").

The result of installing the present invention within tank 12 is to cause ample amounts of ambient air to be distributed within the water of tank 12, where the air temperature of the air distributed within tank 12 is substantially similar to the ambient air surrounding tank 12. By having the air within tank 12 at approximately the ambient temperature of the air surrounding the tank 12, the fish within tank 12 are given markedly increased life expectancy.

The preceding description of the preferred embodiment is for illustrative purposes only and shall not be considered to define the scope of the present invention. Instead, the scope of the present invention shall be determined by the following claims and their equivalents.

I claim:

1. In combination, a tank for containing fish or other aquatic animals, and a device for aerating the water therein comprising:

a fan within a pumping chamber for drawing air through an area of the pumping chamber defining an intake port and forcing air out an area of the pumping chamber defining an exhaust port;

a fan enabling means located outside of the pumping chamber for moving the fan so that air is drawn through the area of the pumping chamber defining the intake port and is forced out the area of the pumping chamber defining the exhaust port;

a means for insulating the pumping chamber from the heat created by the fan enabling means; and, a means for dispersing the air flowing out the exhaust port and communication with said tank.

* * * * *